US005379677A

United States Patent [19]

Ealovega et al.

[11] Patent Number: 5,379,677

[45] Date of Patent: Jan. 10, 1995

[54] FIRE RATE CONTROL SYSTEM FOR A SUBMACHINE GUN OR LIGHT MACHINE GUN

[75] Inventors: George D. Ealovega, Kennebunk, Me.; Richard P. West, Hatfield, England

[73] Assignee: Bushman Limited, St. Albans, England

[21] Appl. No.: 227,572

[22] Filed: Apr. 14, 1994

Related U.S. Application Data

[63] Continuation of Ser. No. 906,882, Jul. 2, 1992, abandoned.

[30] Foreign Application Priority Data

May 12, 1992 [GB] United Kingdom ..... 9210300

[51] Int. Cl.[6] ..... F41A 19/04

[52] U.S. Cl. ..... 89/130

[58] Field of Search ..... 89/129.01, 130, 140, 89/198

[56] References Cited

U.S. PATENT DOCUMENTS

| | | | |
|---|---|---|---|
| 439,248 | 10/1890 | Maxim | 89/129.01 |
| 579,401 | 3/1897 | Maxim | 89/130 |
| 643,118 | 2/1900 | Garland | 89/129.01 |
| 1,511,262 | 10/1924 | Browning | 89/130 |
| 1,573,655 | 2/1926 | Sutter | 89/130 |
| 1,895,719 | 1/1933 | Lahti | 89/129.01 |
| 2,035,303 | 3/1936 | Delacre | 89/129.01 |
| 2,182,907 | 12/1939 | Vollmer | 89/130 |
| 2,748,661 | 6/1956 | Simpson | 89/130 |
| 2,995,988 | 8/1961 | Reed | 89/129.01 |
| 3,650,177 | 3/1972 | Hupp et al. | 89/130 |
| 3,650,177 | 10/1982 | Swieskowski | 89/130 |

FOREIGN PATENT DOCUMENTS

| | | | |
|---|---|---|---|
| 637802 | 5/1928 | France | 89/130 |
| 133980 | 10/1919 | United Kingdom | 89/129.01 |

*Primary Examiner*—Stephen C. Bentley
*Attorney, Agent, or Firm*—Jones, Tullar & Cooper

[57] ABSTRACT

A fire rate control mechanism which allows an open bolt or closed bolt S.M.G. or L.M.G. to be, upon firing, momentarily arrested in a cocked condition and then to be released to fire another round after a predetermined and preset lapse of time.

1 Claim, 6 Drawing Sheets

FIRE RATE CONTROL SYSTEM FOR A SUBMACHINE GUN OR LIGHT MACHINE GUN

This application is a continuation-in-part, of application Ser. No. 07/906,882, filed Jul. 2, 1992, now abandoned.

FIELD OF THE INVENTION

The present invention is directed generally to a fire rate control system for an automatic weapon. More particularly the present invention is directed to a fire rate control system in which the weapons cycle of fire is interrupted for a preset and predetermined period of time. Most specifically, the present invention is directed to the use of a sear to stop the motion of the weapons breech-block and the use of a hydraulic piston cylinder assembly as a release unit to control the sear's subsequent release of the breech-block.

DESCRIPTION OF THE PRIOR ART

A phenomenon known as "climb" or "stitching" is common to most S.M.G.'s in use today. Climb is caused by an excessive rate of fire. For example, when fired on full automatic, a weapon typically does not have sufficient time to return to its original point of aim before each successive round is fired. The general result is one round on target and thereafter a string of uncontrolled shots moving upwards and off target. Such a lack of control of shot placement is obviously both dangerous and very undesirable.

As the requirements of the military and law enforcement called for lighter and more concealable weapons, the laws of physics ensured that with decreased weights came increased rates of fire and therefore increased rates of climb. Current S.M.G.'s (submachine guns) have rates of fire which vary from approximately 600 R.P.M. to over 2,000 R.P.M.

Testing has shown, however, that in S.M.G.'s weighing somewhere between 4.5 and 8 pounds, the phenomenon of climb does not disappear until the rate of fire is brought down below 450 R.P.M. (approximately).

This can be demonstrated by the current model of the BUSHMAN I.D.W. - 9 mm S.M.G. which employs an electronic rate control system set at 420 R.P.M. The weapon weighs 5.7 pounds and does not climb when fired on full auto, even when fired by untrained personnel. In addition, prior art methods of fire rate control are limited in that a particular weapons rate of fire will vary depending on the particular cartridge load used in the weapon. Such an unpredictable rate of fire is undesirable.

OBJECTS AND SUMMARY OF THE INVENTION

It is an object of the present invention to provide a fire-rate control mechanism which can eliminate weapon climb by limiting the firing rate to approximately 450 rpm or to whatever rate is determined, in practice, to eliminate climb for any particular individual weapon model.

It is another object of the present invention to provide a fire rate control mechanism which allows a soldier in the field to alter a weapon's automatic rate of fire by removing and replacing a rate control piston, or to simply replace a defective unit, without the use of tools.

It is another object of the present invention to provide a weapon which can function in either a semiautomatic mode or in an automatic mode with a predetermined rate of fire.

It is another object of the present invention to provide a fire-rate control mechanism which is simple in design, comprised of a minimum of parts, thus ensuring reliability of the mechanism.

It is another object of the present invention to provide a fire-rate control mechanism which provides a weapon which combines the simplicity and safety of an open-bolt system, with the first shot accuracy of a closed bolt system.

It is another object of the present invention to provide a fire-rate control mechanism which is both lightweight and compact enough to be positioned in the pistol grip of a weapon, thus not interfering with the position of the main spring or main spring guide rod or rear breech bolt buffer of the weapon.

It is another object of the present invention to provide a fire rate control mechanism in which the fire rate control piston can be stored separate from the weapon and which can be issued and installed only when required, allowing the weapons automatic fire to be disabled, but still allowing personnel to train with the same weapon in a semiautomatic mode. This is also important with regard to security, since the rate control piston can be located separate from the weapon during storage or transport.

The present invention is a fire rate control mechanism which allows an open bolt or closed bolt S.M.G. or L.M.G. (light machine gun) to be, upon firing, momentarily arrested in a cocked condition and then to be released to fire another round after a predetermined and preset lapse of time.

The mechanism to be described is shown as an alternative to the electronic rate control system employed in the BUSHMAN I.D.W. 9 mm S.M.G. and was developed in parallel so as to share as many components as possible between the two versions. A comparison of the two versions would show that except for the rate control units themselves, the majority of the remaining parts are interchangeable between the two models. The advantage of the new system lies in its simplicity and the reduction of moving parts in the trigger mechanism.

BRIEF DESCRIPTION OF THE DRAWINGS

The foregoing, and additional objects, features and advantages of the present invention will become apparent to those of skill in the art from the following detailed description of the preferred embodiment thereof, taken in conjunction with the accompanying drawings, in which.

FIG's. 1–6 are schematic illustrations of the present invention at various points in the cycle of operation of a weapon, in which.

Figure 1:
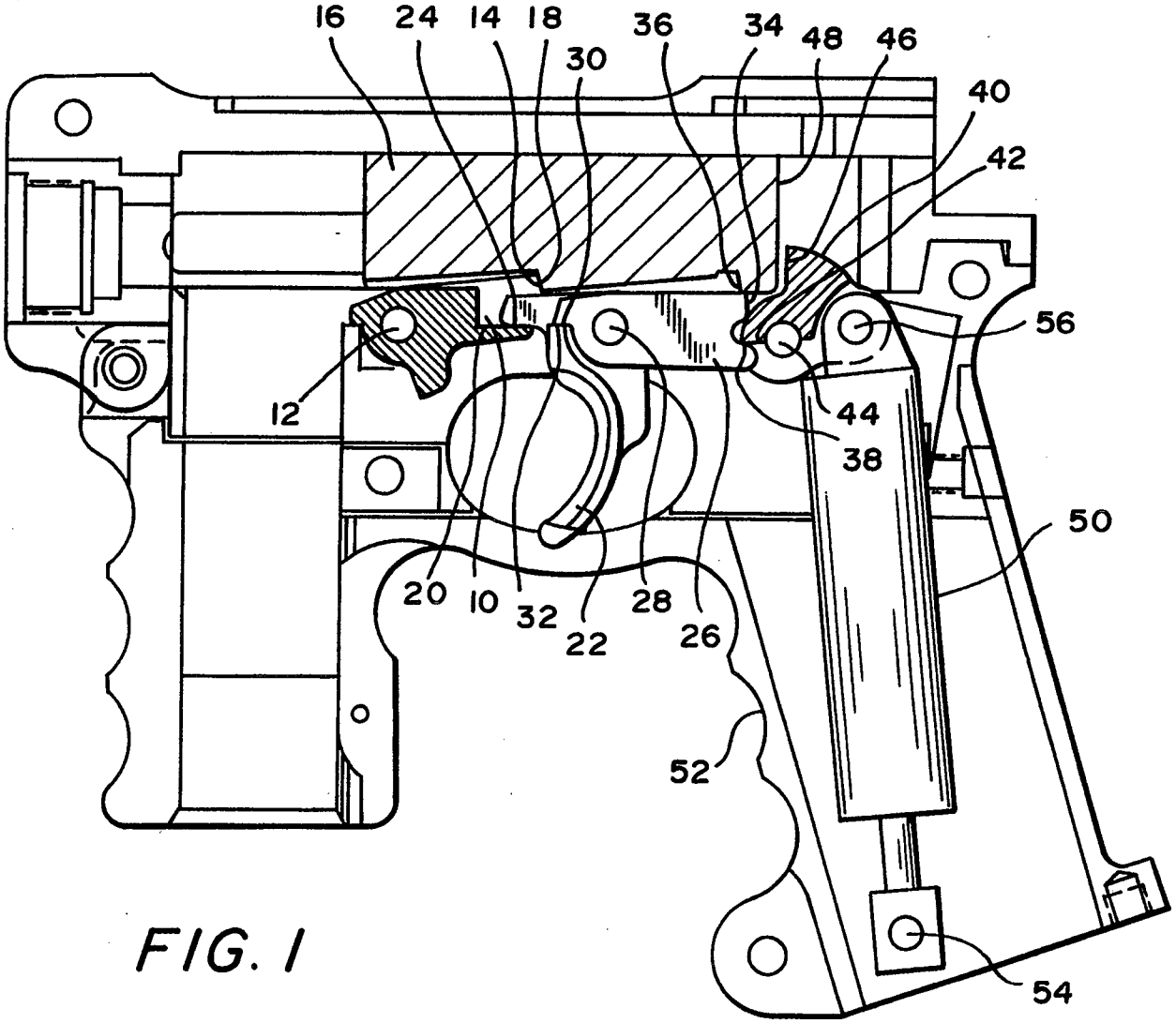
FIG. 1 is a cutaway view of the weapon in a cocked position.

DETAILED DESCRIPTION OF THE PREFERRED EMBODIMENT:

In the drawings and in the description that follows, like reference numerals refer to like elements.

The Figures depict the present invention in an automatic weapon, and illustrate the weapon at various times in the weapons cycle of fire.

Referring generally to the Figures, main sear 10 pivots about shaft 12, and includes sear face 14 for engaging bolt 16 at bent 18, and face 20 for engaging trigger 22 at trigger face 24. Bolt 16 is a particular type of breech-block, as is known in the art. Bolt 16 cycles back and forth within the weapons frame.

Secondary sear 26 and trigger 22 both pivot about shaft 28. Secondary sear 26 includes face 30 for engaging trigger face 32. In addition, secondary sear 26 includes sear face 34 for engaging bolt 16 at bent 36, and point 38 for engaging cam-hammer 40 at cam-hammer face 42.

Cam-hammer 40 pivots about removable pin 44, and includes face 46 for engaging bolt rear face 48.

A very important and key aspect of the instant invention is the use of a release unit to accomplish a timed interruption of the weapons cycle of fire. A preferred form of release unit is embodied in the rate control piston assembly 50. Rate control piston assembly 50 contains hydraulic fluid, fluid chambers and machined orifices for regulating the passage of the fluid between the fluid chambers, in a known manner, thus defining the rate control pistons rate of expansion and therefore the period of interruption of the weapons cycle of fire. An exemplary form of rate control piston assembly is commercially available from Ace Controls, Inc. of Farmington, Mich., Model #92-1201-06.

Further, it is through the removable pins 44 and 54 that another important benefit of the invention is realized. As will be discussed further, these pins allow the removal of the rate control piston in the field, without tools.

Figure 4:
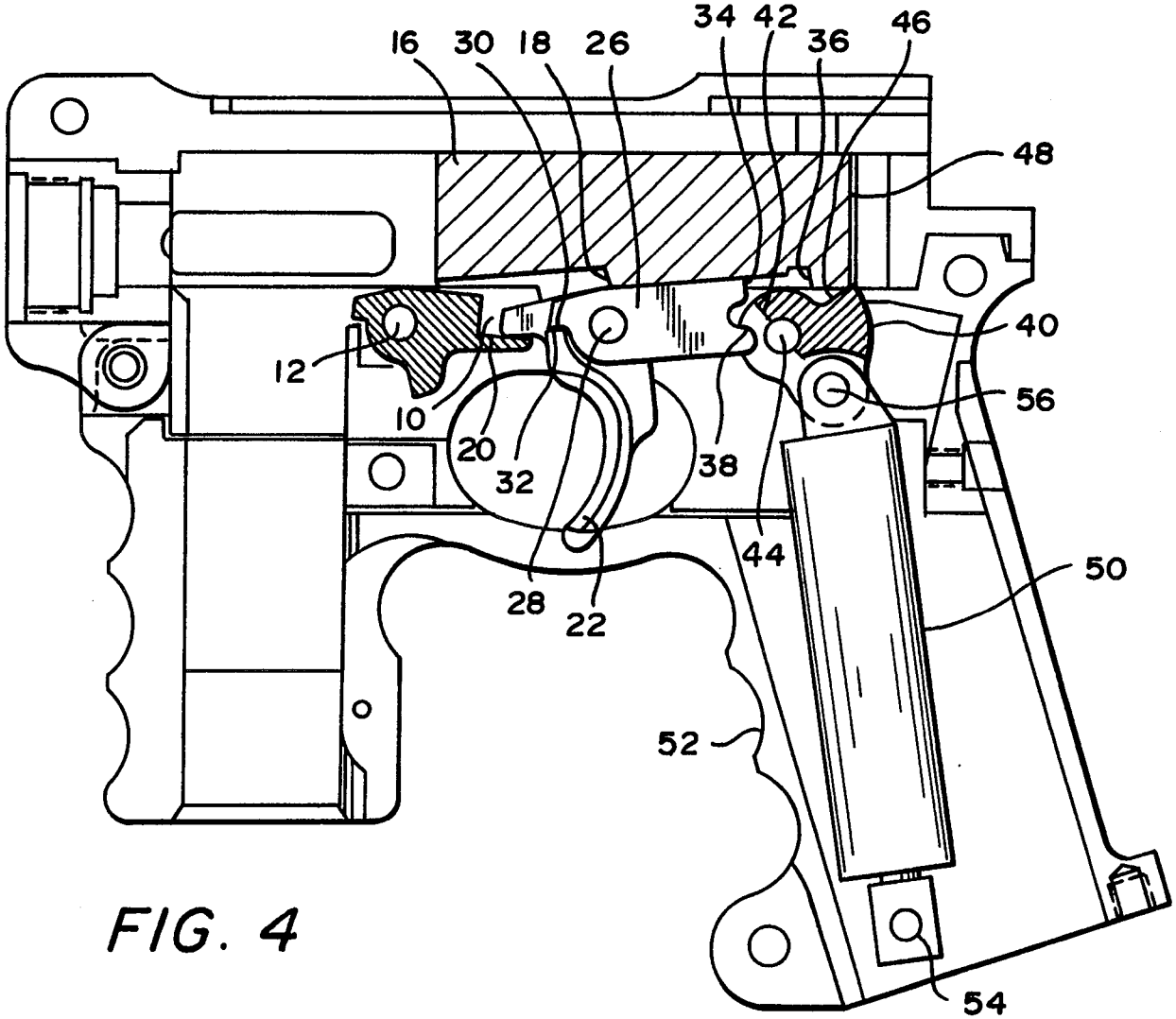
FIG. 4 is a cutaway view of the weapon at a point just after firing.
Figure 5:
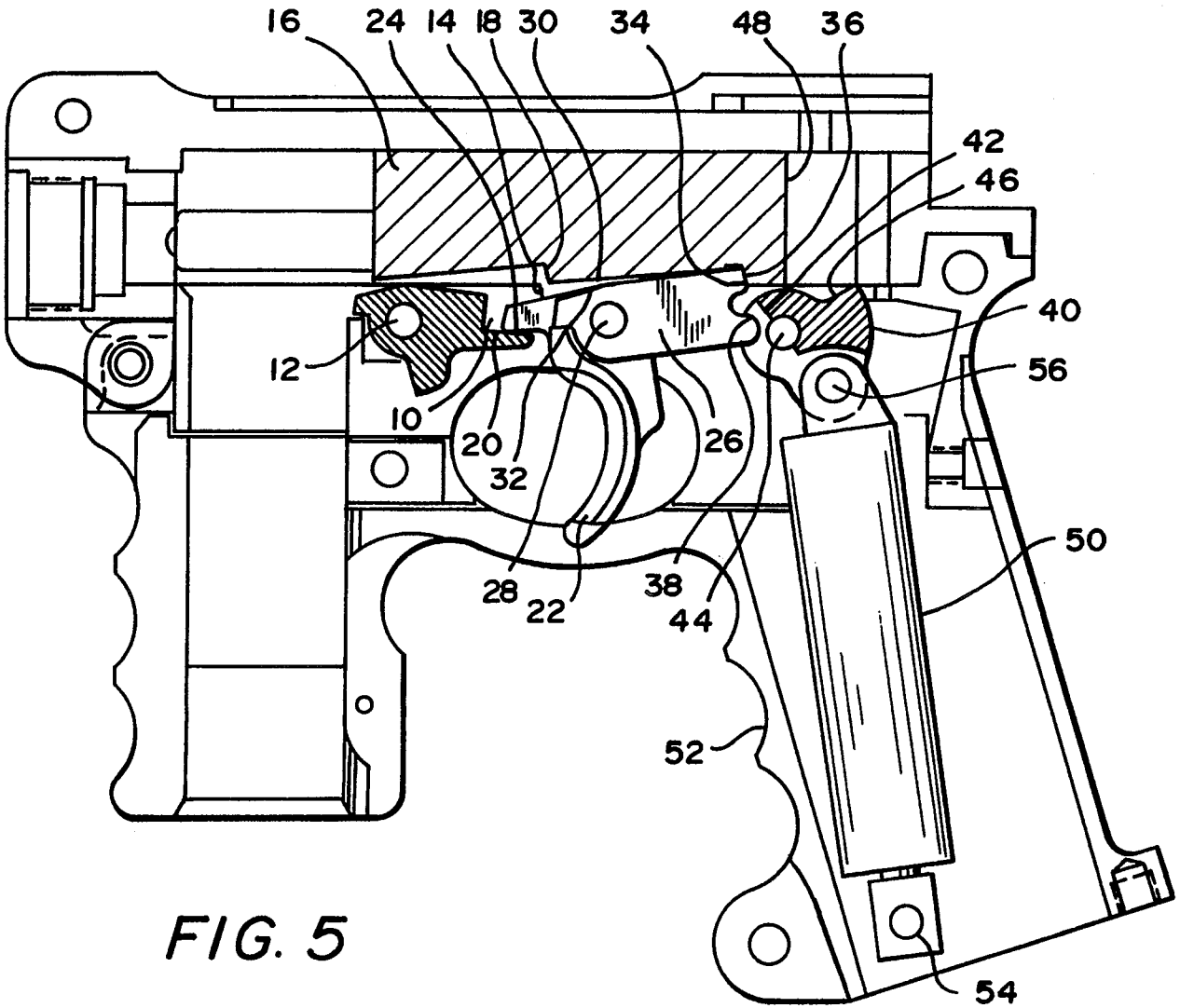
FIG. 5 is a cutaway view of the weapon at a point at which the weapons cycle of fire has been momentarily arrested.
Figure 6:
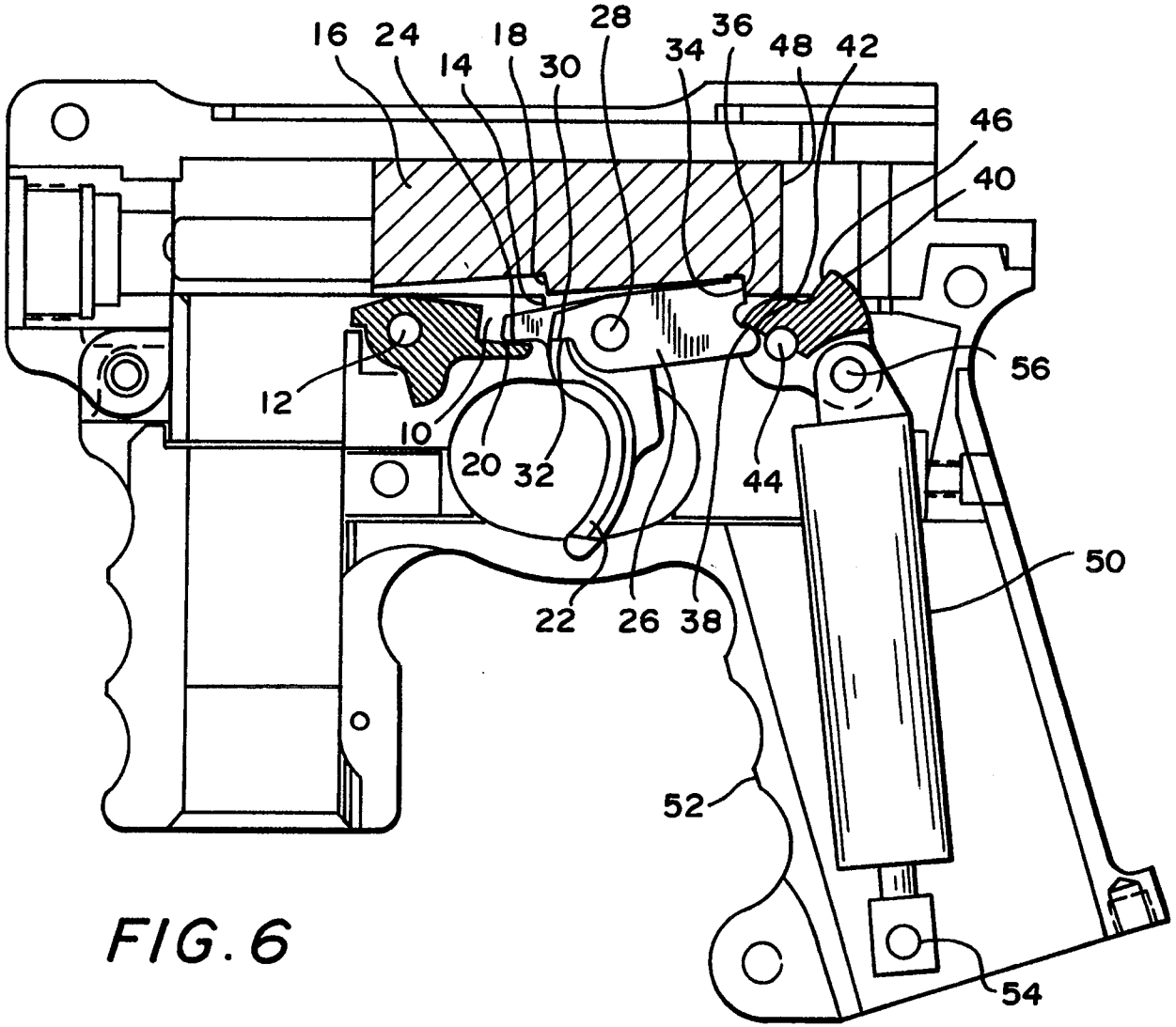
FIG. 6 is a cutaway view of the weapon immediately after having been released from an arrested state.

Turning our attention toward a description of the weapons cycle of fire during semiautomaticfiring, FIG. 1 shows the weapon cocked and ready to fire. For semiautomatic fire the cam-hammer 40 would be locked out of engagement with secondary-sear 26 by a selector unit (not shown) and would be in a position as seen in FIGS. 4 or 5. Main sear 10 is engaged with bolt 16 at bent 18. Trigger 22 forces secondary-sear 26 out of possible engagement with bolt 16 via contact at faces 30 and 32.

Figure 2:
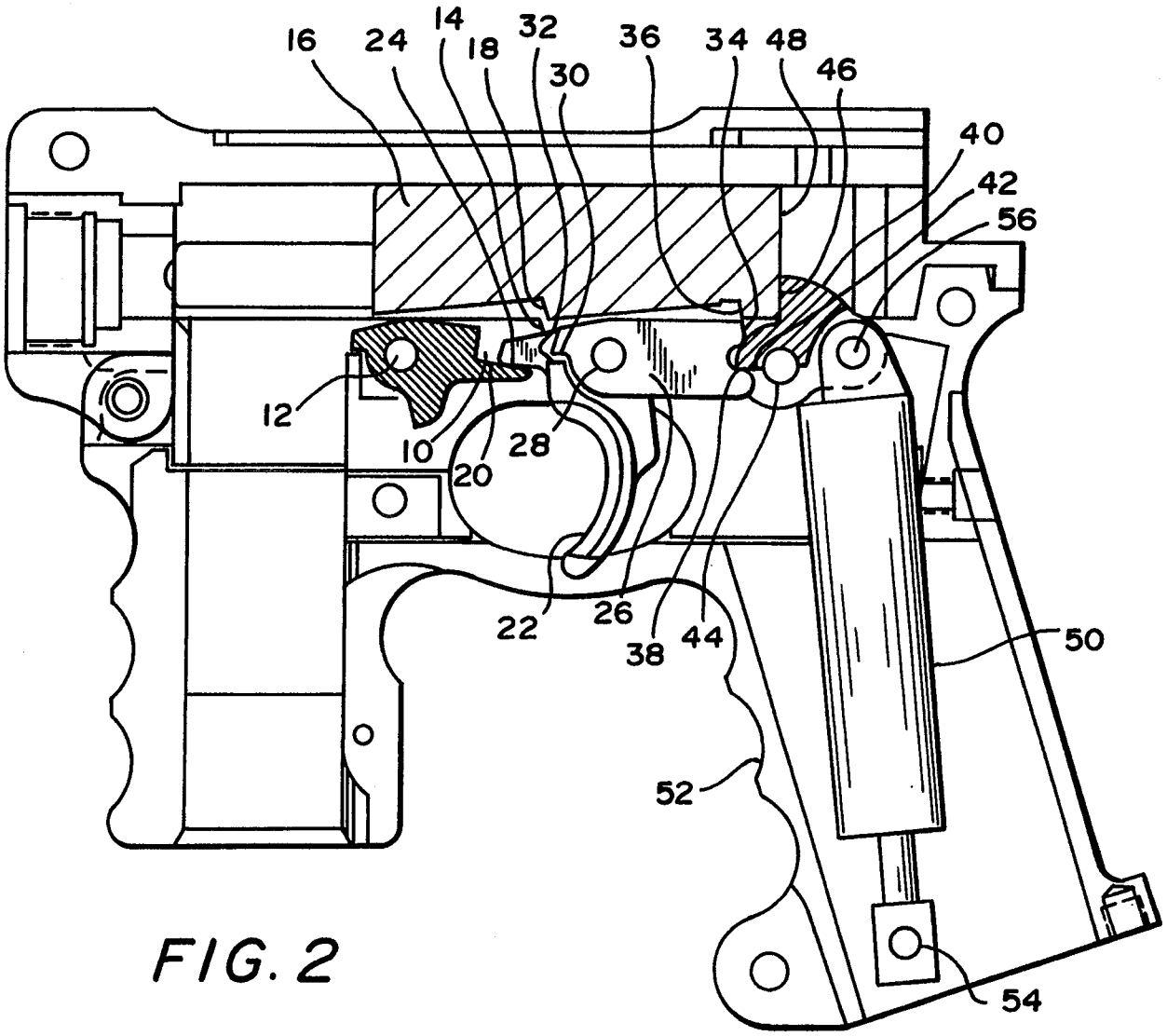
FIG. 2 is a cutaway view of the weapon at a point immediately after the trigger has been pulled.
Figure 3:
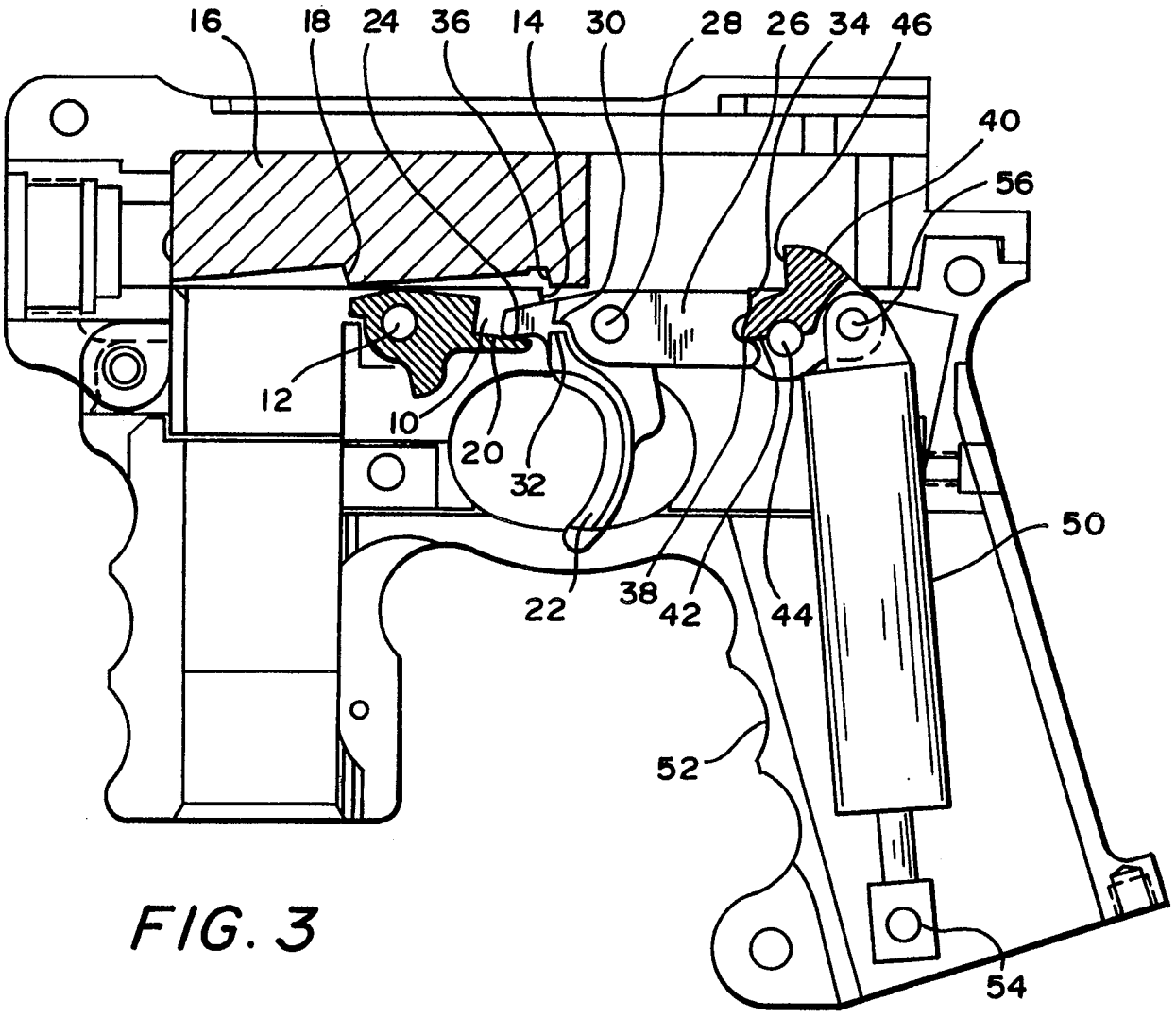
FIG. 3 is a cutaway view of the weapon at the actual point of firing.

Referring to FIG. 2, when trigger 22 is pulled, the trigger pivots about shaft 28, face 24 is forced against sear face 20 and main sear 10 disengages from bolt 16. Simultaneously, trigger 22 disengages contact with secondary-sear 26 at face 30 and 32 such that secondary-sear 26 is now free to engage bolt 16 at bent 36 after a round has been fired. Bolt 16, forced forward via a main spring force (not shown), strips a cartridge from the magazine (not shown), and chambers and fires the cartridge at a position as depicted in FIG. 3.

The force of the exploding cartridge sends the bolt 16 rearward, as shown in FIG. 4. FIG. 5 depicts the point after the bolt 16 has been forced forward via a main spring force (not shown), and in which bolt 16 is engaged and arrested by secondary-sear 26 through contact between sear face 34 and bent 36. When the trigger 22 is released, it's face 32 engages the secondary-sear 26 at face 30 and forces the secondary-sear 26 to disengage from bolt 16. Simultaneously, the main-sear 10 is free to come up and is ready to engage the bolt 16 at bent 18 at the moment the secondary-sear 26 has disengaged from bent 36. The condition is again as depicted in FIG. 1. The weapon is now recocked and ready to be fired via another pull on trigger 22.

Turning to a description of the weapons cycle of fire during regulated full automatic fire, the cam-hammer 40 and fluid filled rate control piston assembly 50 are brought into position. The rate control piston assembly 50 is forced to full extension (via an internal spring force) causing cam-hammer 40 to exert a downward force on secondary-sear 26, through contact between face 42 and point 38, forcing the secondary-sear 26 out of possible engagement with bolt 16. FIGS. 1, 2 and 3 depict a fully extended rate control piston 50.

FIG. 1 depicts the weapon cocked and ready to fire on regulated, fully automatic fire. As in the case of semiautomatic fire, main sear 10 is engaged with bolt 16 at bent 18. Trigger 22 holds secondary sear 26 out of possible engagement with bolt 16, via contact at faces 30 and 32. In addition, in the case of automatic fire, rate control piston assembly 50 is fully extended, causing cam-hammer 40 to rotate about pivot pin 44 such that face 42 is forced into engagement with secondary sear 26 at point 38, ensuring secondary sear face 34 does not come into engagement with bolt 16 at bent 36.

Referring to FIG. 2, the trigger 22, having been pulled, rotates about shaft 28, forces trigger face 24 into engagement with main sear face 20, rotates main sear 10 about pivot shaft 12 and disengages main sear face 14 from bolt bent 18. Bolt 16, forced forward via a main spring force (not shown), strips a cartridge from the magazine (not shown), and chambers and fires the cartridge from a position as depicted in FIG. 3.

Referring to FIG. 4, the explosive forces of the cartridge force the bolt 16 rearward, where the bolt then engages cam-hammer 40 through contact between faces 46 and 48. The bolt 16 forces the cam-hammer 40 to pivot about pin 44, taking the cam-hammer 40 out of engagement with the secondary-sear 26 at point 38 and causing the rate control piston assembly 50 to fully compress against an internal spring force. As the bolt 16 returns forward by a main spring force (not shown) the secondary-sear 26 snaps upwards, engages the bolt 16 at bent 36 and arrests the bolt's forward movement. After the bolt 16 has been arrested by the secondary-sear 26, the rate-control-piston 50 is free to expand at its preset and predetermined rate. As is conventionally known in the piston cylinder arts, the rate of expansion of a hydraulic piston assembly is dictated by the selection of particular internal constituents of the piston cylinder assembly, i.e. by selection of a particular fluid viscosity and/or specific fluid orifice sizes. The expanding piston forces the cam-hammer 40 to pivot about pin 44, forcing face 42 into engagement with the secondary-sear 26 at point 38. When the rate control piston assembly 50 has fully extended, the cam-hammer 40 will have forced secondary-sear 26 out of engagement with bolt 16 at bent 36, freeing the bolt and allowing it to be forced forward by a main spring force (not shown). As the bolt is forced forward the sequence is repeated. The gun will continue to fire at the preset rate until all ammunition is expended or until the trigger 22 is released, allowing the main sear 10 to engage the bolt 16. It is through the use of removable pins 44 and 54 that a weapons rate of fire can be altered by the user, in the field and without tools. Depending on the desired firing rate, a particular firing rate control piston can be inserted into the weapon.

Also, the removable pins allow the user to very easily replace a defective rate control piston.

Rates of fire as low as 100 R.P.M. have been achieved. An infinite control between '0' R.P.M. and the full natural unregulated rate of the weapon can be achieved by altering the internal parameters of the rate control piston, i.e. fluid viscosity, orifice sizes, etc.

Having chosen a firing rate which eliminates climb, and utilizing a shoulder stock, 12" groupings can be achieved at 25 meters firing a continuous 30 round burst. Also, 2 l and 3 round bursts are easily mastered. On semi-automatic mode, 1" groupings have been achieved at 50 meters.

The rate control piston serves a dual function. The rate-control aspect has been explained in the preceding paragraphs. In addition, the rate control piston serves as a decelerator for the bolt. The camming action which occurs as the bolt 16 hits the cam-hammer 40, together with the force exerted by the internal expansion spring within the cylinder 50, serve to absorb a maximum of energy from the returning bolt. This allows the use of a light weight aluminum breech and a very light weight bolt, obviously contributing to the serviceability, reliability and maintainability of the weapon. Typically, open bolt weapons rely on a relatively heavy bolt mass to absorb energy in an effort to reduce the rate of fire of the weapon and to reduce the stress on the breech. This large moving mass is what makes traditional open bolt weapons less accurate than closed bolt versions.

The rate control device as described has alleviated the need for a heavy bolt, thereby retaining the simplicity and safety of an open-bolt system, with first shot accuracy comparable to a closed bolt weapon. Of course, where required, the inventive rate control system can be applied equally well to a closed bolt system.

The use of a rate control piston assembly as described is distinctly different from the prior art methods of fire rate control. In particular, weapons incorporating such prior art inertial methods, including the use of springs or shock absorbers, for instance, are subject to a changing rate of fire depending on the particular cartridge load utilized. Weapons which incorporate the subject invention, on the other hand, do not experience a changing rate of fire depending on a particular cartridge loading. The fire rate control piston assembly of the present invention controls a weapons fire rate depending on the particulars chosen for each piston assembly, as has been discussed. The timed release of the breechblock of the weapon is a preset and predetermined quantity.

In summary, the present invention is a fire rate control mechanism which allows an open bolt or closed bolt S.M.G. or L.M.G. to be, upon firing, momentarily arrested in a cocked condition and then to be released to fire another round after a predetermined and preset lapse of time and which provides a weapon which can function in either a semi-automatic mode or in an automatic mode. The present invention provides a fire rate control mechanism which allows a soldier in the field to alter a weapon's automatic rate of fire by removing and replacing a rate control piston, or to replace a defective unit, without the use of tools, in approximately one minutes time, or less.

In addition, the present invention provides a fire-rate control mechanism which is simple in design, comprised of a minimum of parts, thus ensuring reliability of the mechanism.

Also, the present invention provides a fire-rate control mechanism which can eliminate weapon climb by limiting the firing rate to approximately 450 rpm or to whatever rate is determined, in practice, to eliminate climb for any particular individual weapon model.

Further, the present invention provides a fire-rate control mechanism which is both lightweight and compact enough to be positioned in the pistol grip of a weapon, thus not interfering with the position of the main spring or main spring guide rod or rear breech bolt buffer of the weapon.

Finally, the present invention provides a fire rate control mechanism in which the fire rate control piston can be stored separate from the weapon and which can be issued and installed only when required.

While a preferred embodiment of a fire rate control system for a submachine gun or light machine gun utilizing a hydraulic cylinder release unit in accordance with the present invention has been set forth fully and completely hereinabove, it will be apparent to one of skill in the art that a number of changes could be made, for example, in the type of release unit, i.e. the use of a gas cylinder or a mechanical release means, without departing from the true spirit and scope of the subject invention which is accordingly to be limited only by the following claims.

I claim:

1. A weapon having a controllable rate of fire, said weapon comprising:

a frame;

a bolt movable forwardly and rearwardly in said frame, said bolt having a rear face;

first and second bents disposed longitudinally on a bottom portion of said bolt;

a main sear for releasably arresting said forward movement of said bolt during a semi-automatic mode of operation of said weapon, said main sear being pivotably mounted within said frame and having a first main sear face for releaseably engaging said first bent to prevent forward bolt movement, and a second main sear face;

a secondary sear for releasably arresting said forward movement of said bolt during an automatic mode of operation of said weapon, said secondary sear being pivotably mounted within said frame and having a first secondary sear face for releaseably engaging said second bent to prevent forward bolt movement, a second secondary sear face, and, a third secondary sear face;

a trigger having a first trigger face and being pivotably mounted in said frame, said trigger being usable to control said pivotable movements of said main and secondary sears, actuation of said trigger moving said first trigger face into contact with said second main sear face for pivoting said main sear and releasing said engagement between said first main sear face and said first bent;

a cam hammer having a first cam hammer face and being mounted in said frame for pivotable movement, said cam hammer being usable to control said releaseable engagement between said first secondary sear face and said second bent, movement of said cam hammer forcing said first cam hammer face to contact said third secondary sear face, pivoting said secondary sear and releasing said engagement between said first secondary sear face and said second bent, said cam hammer further having a second cam hammer face engageable with said rear face portion of said bolt during rearward motion of said bolt;

a rate control assembly usable to control said pivotable movement of said cam hammer, said rate control assembly being compressed in response to pivoting of said cam hammer during rearward motion of said bolt, said rate control assembly having a predetermined and preset expansion rate for controlling the pivoting motion of said cam hammer to release the engagement between said first secondary sear face and said second bent, said predetermined and preset expansion rate being selectable to control a rate of fire and amount of climb of said weapon; and, a first releaseable pin connecting a first end of said rate control assembly to said frame, a pivot pin connecting a second end of said rate control assembly to said cam hammer and a second releaseable pin connecting said cam hammer to said frame, said first and second releaseable pins facilitating quick removal and replacement of said rate control assembly absent the use of tools.

* * * * *